United States Patent [19]

Chielens et al.

[11] Patent Number: 4,463,795

[45] Date of Patent: Aug. 7, 1984

[54] METHOD OF COOLING A CONTINUOUS CASTING

[75] Inventors: Alain Chielens, Marcq en Baroeul; Philippe Benoit; Bernard Roggo, both of Lambersart, all of France

[73] Assignee: Fives-Cail Babcock, Paris, France

[21] Appl. No.: 242,143

[22] Filed: Mar. 9, 1981

[30] Foreign Application Priority Data

Mar. 13, 1980 [FR] France ..... 80 05592

[51] Int. Cl.[3] ..... B22D 11/16

[52] U.S. Cl. ..... 164/455; 164/414

[58] Field of Search ..... 164/414, 444, 455, 486

[56] References Cited

U.S. PATENT DOCUMENTS 3,478,808 11/1969 Adams ..... 164/453
3,915,216 10/1975 Fekete ..... 164/4
4,073,332 2/1978 Etienne ..... 164/4

FOREIGN PATENT DOCUMENTS 2636666 8/1976 Fed. Rep. of Germany ..... 164/444

*Primary Examiner*—Kuang Y. Lin

*Assistant Examiner*—Richard K. Seidel

*Attorney, Agent, or Firm*—Kurt Kelman

[57] ABSTRACT

The cooling of a cast steel slab in a continuous casting installation is controlled by dividing the cast product into successive fictitious elements and periodically calculating the water flow values of the cooling water delivered to the successive cooling sections in the secondary cooling zone of the installation as a function of the age of the elements in these sections. The quantity of heat extracted in the mold is taken into account by periodically determining the water flow values in the different zones by means of a computer on the basis of a first curve giving the variations of the quantity of heat extracted from a unitary mass of the cast product as a function of the time while the cast product passes from the point of emergence from the mold to at least the zone of solidification, and a second curve giving the variations of the surface temperature of the cast product during this passage as a function of time. Before each calculation of the water flow values, the first curve is corrected in direct dependence on the quantity of heat extracted from the product in the mold.

13 Claims, 6 Drawing Figures

METHOD OF COOLING A CONTINUOUS CASTING

The present invention relates to a continuous casting installation comprising a mold containing molten metal for casting a metallic product, such as a steel bloom, slab or billet, and a secondary cooling zone including a succession of cooling sections through which the cast product is guided from a point of emergence from the mold to a zone of solidification of the cast product, each successive element of the cast product having at any time an age which is a function of its position in the installation. In such an installation, the molten metal begins to solidify in the mold where a relatively thin skin is formed around the product and continues to solidify progressively inwardly in the secondary cooling zone which is equipped with cooling sections containing suitable water spray means.

The function of the cooling in the secondary cooling zone is to assure a regular growth of the skin formed in the mold until the product has been completely solidified in the form of a desired shape of the cast product at the end of the predetermined dwell time in the cooling zone. Sufficient flows of cooling water must be projected against the cast product to maintain the temperature of the skin of the product at a level low enough to make the skin suitably mechanically resistant. On the other hand, if the flow of the cooling water is too large, the temperature of the cast product at the end of the usually curved guide rack in which the product is cooled is too low to keep the product sufficiently ductile during its guidance from the curved guidance path to the rectilinear path in the straightening zone. This may lead to an unacceptable reduction of the ductility of the metal due to the fact that the deformations to which the curved cast product is subjected in the straightening zone exceed the acceptable limits of the cooled cast product. Generally, non-controlled cooling of the cast product may cause significant metallurgical faults in the cast product, particularly internal and surface fissures.

Therefore, it is essential to control the cooling of the cast product in a continuous casting installation to provide a high-quality casting and different systems have been proposed to obtain this cooling control.

For example, it has been proposed to maintain the total flow of the cooling water in the installation proportional to the casting speed, with the distribution of the water in the successive cooling sections being predetermined. In other installations, the flow rate of the cooling water is controlled in dependence on the casting speed so as to maintain the water spraying rate (flow of water/flow of metal) proportional to this speed.

In other known continuous casting installations, the total cooling water flow is periodically controlled or the partial flows of water in one or several of the cooling sections in the secondary cooling zone are controlled in dependence on the age of the elements of the cast product in each section, these elements being fictitiously formed during intervals of time equal to the period of the control. For this purpose, it has been proposed to use one or more curves giving the variations of the water flow rate as a function of the age of the product. These curves are pre-established on the basis of experimental results and calculations.

All the known control systems which merely maintain variable cooling water flow rates following different but always predetermined laws ignore the actual cooling process and do not take the variations of certain process parameters into account, particularly the quantity of heat extracted in the mold and the thermal profile of the cast product.

It is the primary object of this invention to provide a method of cooling a cast metallic product, which takes into account the actual behavior and the thermal history of the cast product in a continuous casting installation.

The above and other objects are accomplished according to the invention by periodically calculating the water flow rates on the basis of a first curve giving the variations of the quantity of heat extracted from a unitary mass of the cast product as a function of its dwell time in the mold and in the secondary cooling zone, and of a second curve associated with the first one by laws of thermal behavior and representing the variations, as a function of the dwell time in the installation, of the surface temperature of the cast product. These curves are preestablished with the aid of a mathematical model of simulation of the thermal behavior of a standardized cast product by experimental results.

In fictitiously dividing the cast product into elements and in periodically determining the age of each element, the quantity of heat extracted from each element and its surface temperature are calculated on the basis of these curves, whereupon the coefficient of thermal exchange for each element is calculated. With the aid of a curve giving the variations of the specific cooling water flow rates as a function of the thermal exchange coefficient, the water flows projected on each element are determined and then the water flow rates of each cooling section of the secondary cooling zone are calculated by integrating the water flow rate for all the elements present at the moment in each cooling section. The water flow rates of the cooling water delivered to the different cooling sections are then so controlled as to maintain them at the calculated values.

The equations forming the basis for the curves of the extracted heat and the surface temperature comprise parameters whose values vary from casting to casting, i.e. the nature of the cast metal and the shape of the cast product. Therefore, it is necessary to have available a set of curves for each type of metal and each shape of product to be cast in the installation.

The tracing of these curves also depends on the quantity of the heat extracted in the mold and the method of the present invention makes it possible readily to take this parameter into account. The calculations have actually shown that the thermal efficiency of the mold only displaces the curve of the quantity of heat extracted in relation to the axis of time. In other words, the different curves of the variation of the quantity of heat extracted in the secondary cooling zone may be deduced simply by transferring the curve along the axis of time.

In accordance with this invention, the quantity of heat extracted in the mold is determined, the curve of the extracted quantity of heat is corrected by displacing it parallel to the axis of time so that it passes through a point whose coordinates are the dwell time of the product in the mold and the quantity of heat extracted therein, and the water flow rates are calculated on the basis of this corrected curve.

The quantity of heat extracted in the mold may be determined by measuring the flow rate and heating of the cooling water for the mold or the flow rate and heating of the cooling water at the four faces of the mold.

It is also possible to determine the quantity of heat extracted in the mold on the basis of data stored in the memory of the computer and established by previous calculations of simulation and/or experiments.

If the real surface temperature of the cast product at the outlet or point of emergence from the mold is not equal to the temperature given by the curve of surface temperatures, this curve is corrected by connecting a point whose coordinates are the dwell time in the mold and the surface temperature of the product at the outlet of the mold by a straight line or a curve of the second or third degree to a point of the curve corresponding to an upper section of the secondary cooling zone. The water flow rates are then calculated on the basis of this corrected curve.

The surface temperature of the product at the outlet of the mold is measured by an optical pyrometer or it is calculated on the basis of the quantity of heat extracted in the mold by means of a curve established with the aid of previous calculations of simulation.

Normally, the profile of the surface temperature imposed on the secondary cooling zone makes it possible to attain the desired temperature at the end of the cooling zone, particularly at the point where the slab is straightened in the continuous casting installation. However, the effectiveness of the cooling arrangement may accidentally vary, for example by fouling or wear of the water spray nozzles.

According to another preferred feature of the invention, the slab-surface temperature at the end of the secondary cooling zone or, in case of a curved guide-rack, in the vicinity of the straightening zone is periodically compared with the desired temperature. If the difference between these temperatures exceeds a predetermined value, the water flow rates in the last cooling sections of the secondary cooling zone are corrected. First, the water flow rate in the last cooling section next to the straightener is corrected. The extent of this correction is a function of the difference in the two temperatures which are compared. If, after a predetermined lapse of time, this difference is still too large, the water flow rate of one or more of the preceding cooling sections is corrected until the difference between the measured surface temperature and the desired surface temperature of the cast product in the straightener is within the predetermined and acceptable range.

To keep within the metallurgical constraints, a family of curves of the extracted quantity of heat and of the surface temperature corresponding to different casting speeds is utilized. In accordance with yet another preferred feature of the present invention, several classes of casting speeds are defined and a set of curves of the extracted quantity of heat and of the surface temperature is associated with each defined casting speed class. For a given casting speed, the water flow values are calculated on the basis of the set of curves corresponding to the class into which this given casting speed falls.

If the casting speed is changed during a short period of time (say, of the order of two to four minutes) and the initial casting speed is then resumed, the water flow rates are calculated during the transitory period of time on the basis of the curves corresponding to the initial casting speed. However, if the initial casting speed is changed for a period of time exceeding a predetermined lower limit (say, about five minutes), a law of variation of the water flow rates is established after the expiration of this excessive period of time on the basis of two sets of curves corresponding to the initial and the final casting speeds, which limits the speed of variations in the surface temperature to a predetermined value (say, from 10° C. to 200° C. per minute). This law is applied to calculate the flow rates until they correspond to the new casting speed.

It is also possible to divide the cast product fictitiously into elements, to determine the age of each successive element periodically, to calculate the average casting speed for each one of these elements, to calculate the specific water flow projected on each element on the basis of a set of curves corresponding to this average casting speed, and to calculate the water flow rate for each cooling section in the secondary cooling zone by integrating the calculated water flow rates for all the elements in this cooling section. The average casting speed of an element of the cast product is defined as the quotient of the distance transversed by the element in the continuous casting installation and the age of this element.

Since the average speed of the elements in any given cooling section of the secondary cooling zone varies progressively from the initial to the final casting speed, the water flow rates in the different cooling sections will gradually change as they are calculated periodically in the above-indicated manner.

The fictitious division of the cast product into successive elements or slices is utilized in a manner similar to that of conventional cooling methods to determine at any given moment the age of the different elements, information on the basis of which the quantities of heat to be extracted, the surface temperatures, the coefficients of heat exchange, and the specific water flows assigned to the different cooling sections in the secondary cooling zone are calculated.

The above and other objects, advantages and features of the present invention will become more apparent from the following detailed description of a now preferred embodiment thereof, taken in conjunction with the accompanying drawing, wherein.

Figure 1:
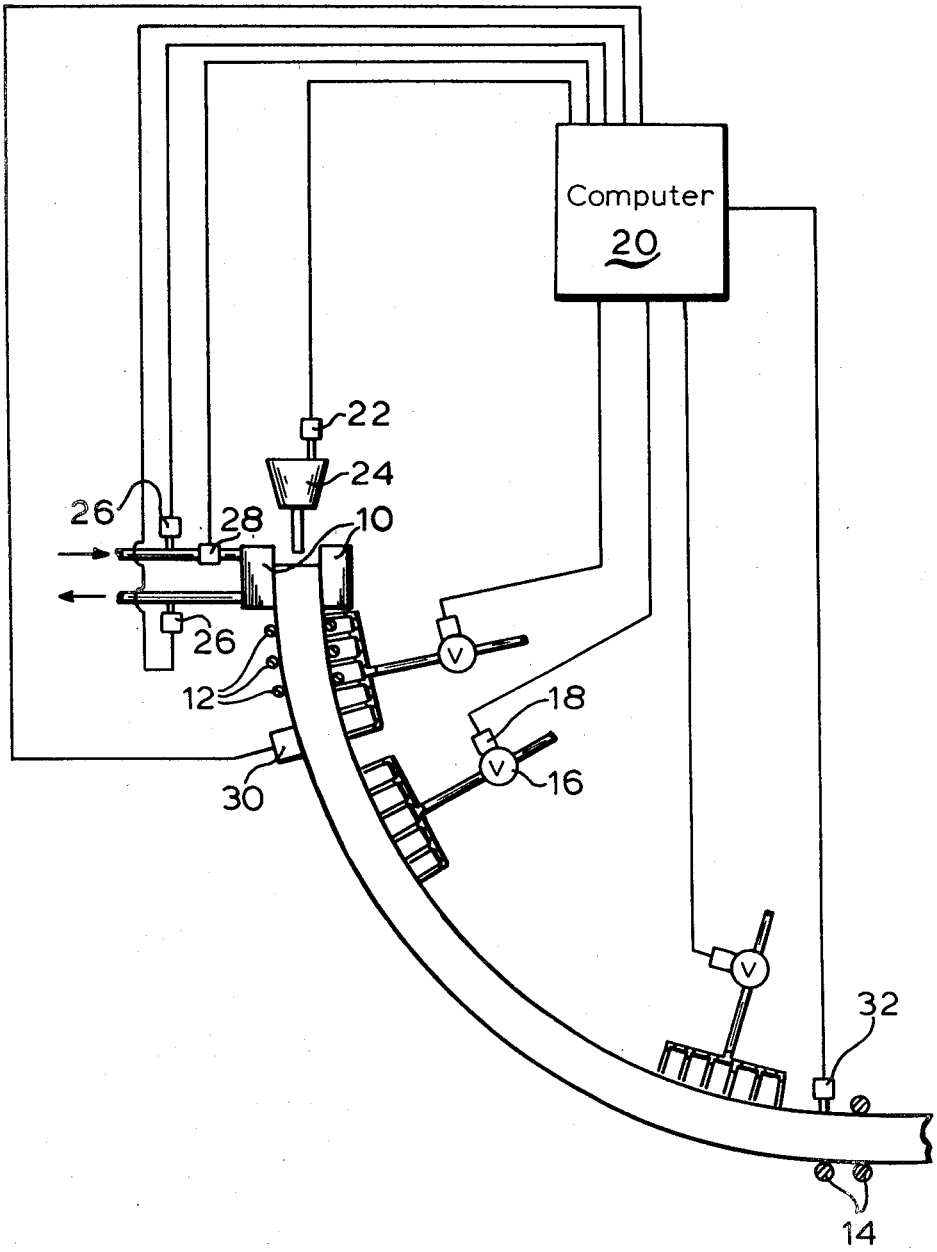
FIG. 1 is a schematic side elevational view of a continuous casting installation and the control for cooling the cast metal slab produced in this installation.

Referring now to the drawing and first to FIG. 1, there is shown a generally conventional continuous casting installation for casting steel slabs, by way of example, which comprises tundish 24 delivering molten metal into water-cooled mold 10 whence emerges a continuous cast product which passes through guide-roll rack 12 to slab straightener 14. The guide-roll rack constitutes a cooling zone for the cast product and, for this purpose, water spray headers are disposed along the rack, the spray nozzles or ramps of each header receiving a flow of water from a water delivery conduit to which the nozzles or ramps are connected in parallel. The water flow to each header is controlled by valve 16 whose opening is controlled by control 18. An output of computer 20 is connected to control 18 and delivers thereto a control signal so that the flow rate of water to the water spray header is determined by the control signal from computer 20. The water spray nozzles or ramps may be distributed all around the cast product as it passes through guide-roll rack 12 or, if a slab of rectangular cross section is cast, they may be disposed solely facing the two large faces of the slab. Manually operable means are provided for distributing the total flow of water fed to each header to the different nozzles or ramps.

As has been described in "The Making, Shaping and Treating of Steel", page 713, the Gary Works of U.S. Steel Corporation has a water-spray slab-cooling system controlled by a digital computer that calculates and automatically sets up all water flows throughout the spray chamber so that the desired slab-surface temperatures will be attained at different locations in the chamber. The settings are varied to match the type of steel to be cast and the casting speed at start. The computer subsequently monitors the temperature at strategic locations, checks the casting speed and automatically modifies the flow of water to maintain the desired slab-surface temperatures.

The specific and modified cooling control system of this invention will be described hereinafter. It includes specific measuring devices monitoring the casting operation and connected to computer 20 to transmit input signals thereto.

Thermocouple 22 measures the temperature of the molten metal in tundish 24 and feeds a corresponding input signal to the computer.

Thermoelectric probes 26 measure the temperature of the water used to cool mold 10 at the inlet and outlet of the mold cooling system, respectively, and feed corresponding input signals to the computer.

Flowmeter 28 measures the flow of cooling water passing through the mold cooling system and feeds a corresponding input signal to the computer.

Pulse generator 30 measure the speed of extraction (casting speed) of the slab and calculates the age of elements of the slab passing by the pulse generator, feeding a corresponding input signal to the computer.

Finally, pyrometer 32 measures the surface temperature of the slab in the range of slab straightener 14 at the end of the cooling zone and feeds a corresponding input signal to the computer.

On the basis of these input signals corresponding to the described operating parameters of the continuous casting and predetermined constants stored in the memory of the computer, computer 20 at regular intervals generates output signals to controls 18 of valves 16 controlling the water flow to each rate of water-spray header so as to determine the water flow to the different sections of the cooling zone. The regular time interval between the control signals generated by the computer may be, for example, one to fifty seconds.

Figure 2:
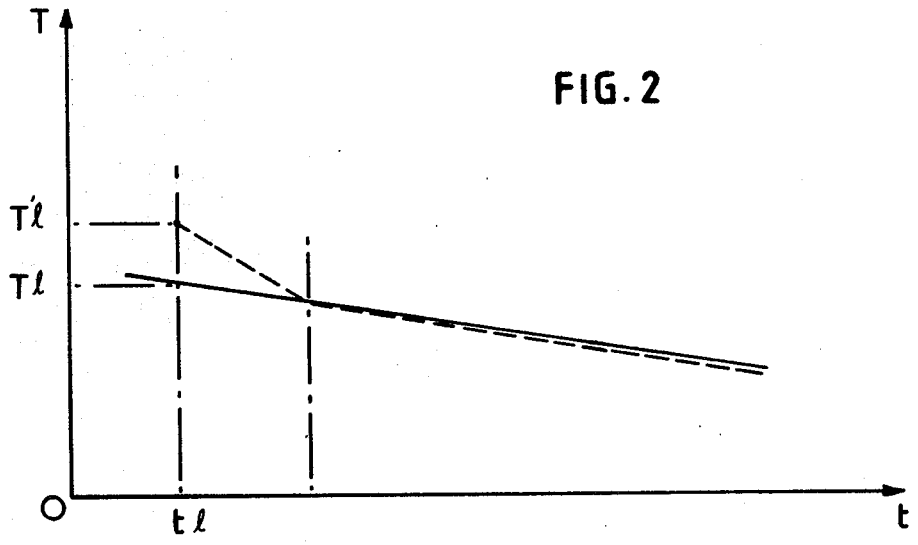
FIG. 2 shows a curve representing the variations of the surface temperature of the cast slab during its displacement in the installation, as a function of time.

The principle of the cooling control according to the invention is maintained during the time of the progressive solidification of the slab, regardless of the specific operation of the continuous casting installation. For this purpose, the control signal from the computer is subject to a law of variation of the quantity of heat C extracted from the slab per weight (kilogram) of steel, as a function of the dwell time t in the installation (FIG. 3), with which is associated a law of variation of the surface temperature T of the slab, also as a function of the dwell time t in the installation (FIG. 2). These laws depend essentially on the type of steel cast, the shape of the slab or billet, and the casting speed. In practice, for a given shape of the cast product, the types of steel and the casting speeds will be grouped in different classes. For the types of steel, the number of classes will depend on the steel plant. The casting speeds may be classified, for example, into three groups: high, medium and slow. Therefore, three sets of curves $C=f(t)$ and $T=g(t)$ will have to be established for each shape of cast product and each class of type of steel.

Figure 4:
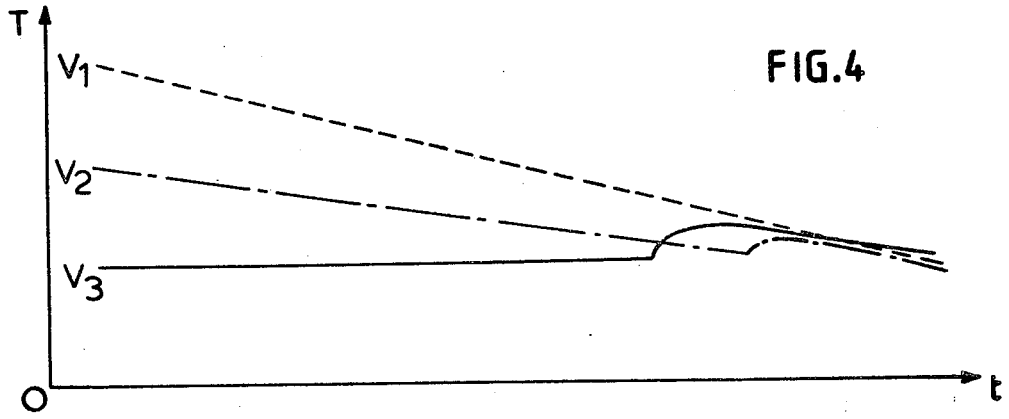
FIG. 4 shows several curves of the variation of the surface temperature of the cast slab for different extraction speeds, as a function of time.
Figure 5:
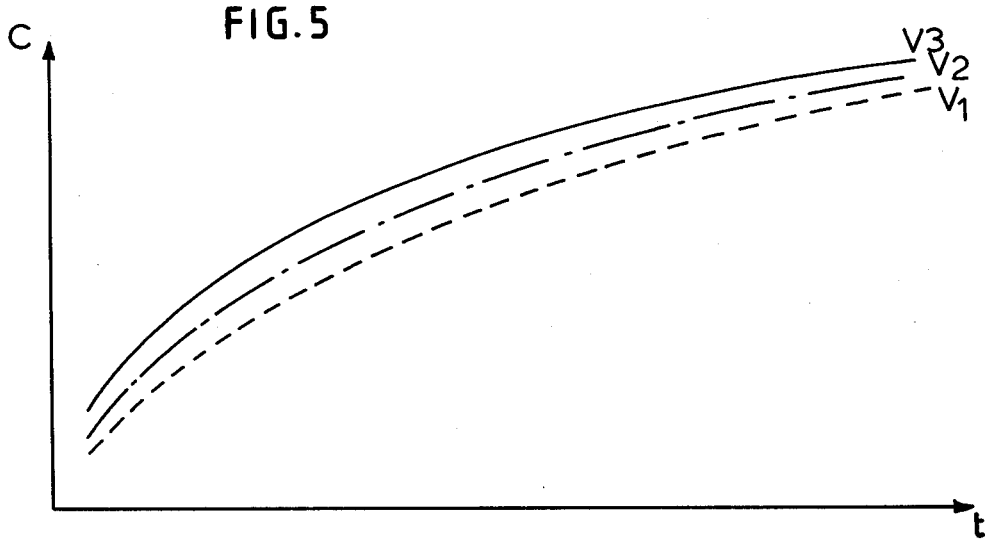
FIG. 5 shows several curves of the variations of the extracted heat for different extraction speeds, as a function of time.

FIGS. 4 and 5 show families of curves $T=g(t)$ and $C=f(t)$, respectively, corresponding to different classes of speeds $V_1$, $V_2$ and $V_3$ for a given shape of cast product and a given class of a type of steel, with $V_1<V_2<V_3$.

The slab-surface temperature entered on the curves $T=g(t)$ may be the temperature of a point on the median line of a face of the slab, or the average of the temperatures on the median lines on the four faces of the slab, or the average temperature on the width of one face, or on the entire periphery of the slab. It may also be the average temperature on the median part of one face of the slab or the average of the average temperatures of the median parts of the four faces of the slab.

All the curves are defined by parametric equations or by point values introduced into the memory of the computer. The constants determined by the type of steel and the shape of the cast product are introduced into the computer before each casting to permit the computer to select the set of corresponding curves. The casting speed is permanently measured by pulse generator 30 and the computer selects at each moment the set of curves corresponding to the average casting speed derived from the measurements of pulse generator 30.

Figure 6:
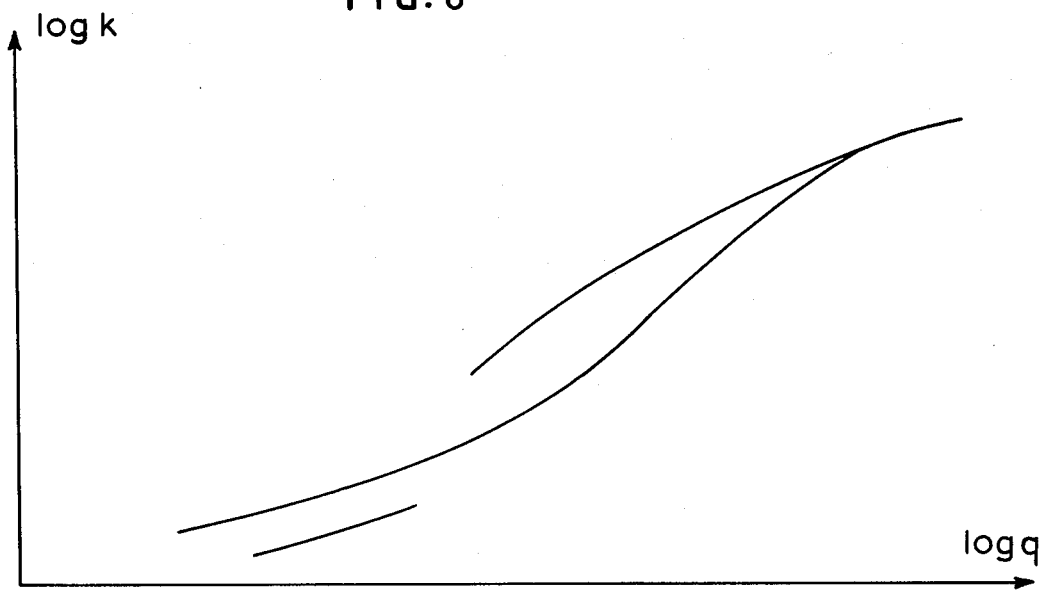
FIG. 6 shows a curve in several sections valid in different sections of the cooling zone and representing variations in the coefficient of the surface heat exchange, as a function of the specific water flow rate.

From the selected set of curves, computer 20 can calculate, at every moment, the coefficient of surface thermal exchange K for each element of the slab, on the basis of the extracted quantity of heat C and slab-surface temperature T, and generate a corresponding control signal to determine a specific rate of flow of cooling water q to be projected or sprayed onto a surface unit of the slab element considered, with the aid of a curve $K=h(q)$ stored in the memory of the computer and shown in FIG. 6. This curve may apply to the entire cooling zone or it may be constituted by several distinct curve sections each appliable to a different section of the cooling zone. This curve $K=h(q)$ may relate to the entire periphery of the cast product, in which case the global cooling phenomenon is considered. It may also relate to the median parts of the four faces of the slab, in which case the local cooling phenomena on the periphery of the slab are considered.

The calculation is effected in computer 20 periodically, for example every ten seconds, and the cast product is fictitiously divided into elements whose length is that of the portion of the casting in the time interval between two successive calculations. The number of the order assigned to each element of the cast product from its time of production thus permits the age of each such element and its position in the casting installation to be known at every moment.

Supposing that, for an element of the slab, curves $C=f(t)$ and $T=g(t)$ give values $C_1$ and $T_1$ for a dwell time $t_1$ and $C_2$ and $T_2$ for dwell time $t_2=t_1+\Delta t$, the quantity of heat extracted from a unitary mass of this slab element will be $\Delta C=C_2-C_1$ for the period of time $\Delta t$.

If L is the length of the slab element, l the width of the slab, e its thickness and $\rho$ the specific mass of the metal, the heat flux extracted from this slab element in the course of the period of time $\Delta t$ will be $$\phi = \frac{\Delta C \times L \times l \times e \times \rho}{\Delta t}$$

The density of the heat flux extracted from the lateral surface S of the periphery of the slab element will be $$\rho = \frac{\phi}{S} = \frac{\Delta C \times l \times e \times \rho}{2\Delta t \times (l + e)}$$

and the coefficient of heat exchange over the periphery of the element will be $$K = \frac{\rho}{T} = \frac{\Delta C \times l \times e \times \rho}{2T \times \Delta t \times (l + e)}, \; T = \frac{T_1 + T_2}{2}$$

being the average surface temperature of the slab element.

The curve $K=h(q)$ gives, on the basis of the value calculated for K, the specific water flow q for this slab element, which permits calculation of the water flow $Q=q\times S$ to be projected against the lateral surface of the element.

This method is slightly modified if the faces of the slab are not cooled by projection of water against the entire width. In this case, only the median portion of the faces of the element are considered, that is, S represents only the total surface of these median portion and T is the average surface temperature over this surface.

After the rate of the water flow to be projected against each slab element present at a given moment in the cooling zone has been calculated, the rates for the water flows feeding the different sections of the cooling zone are calculated by integration and the calculated rates are transmitted from the computer to respective controls 18.

In case the nozzles or other spray means supply the water in finely divided droplets produced by air pressure, the total flow of water in the cooling zone is calculated and the flow of air is deducted therefrom by means of an equation or a curve establishing a relation between the water flow and the flow of pressurized air. Means are provided for manually controlling the distribution between the different cooling zone sections of the total air flow fed to the cooling zone.

Figure 3:
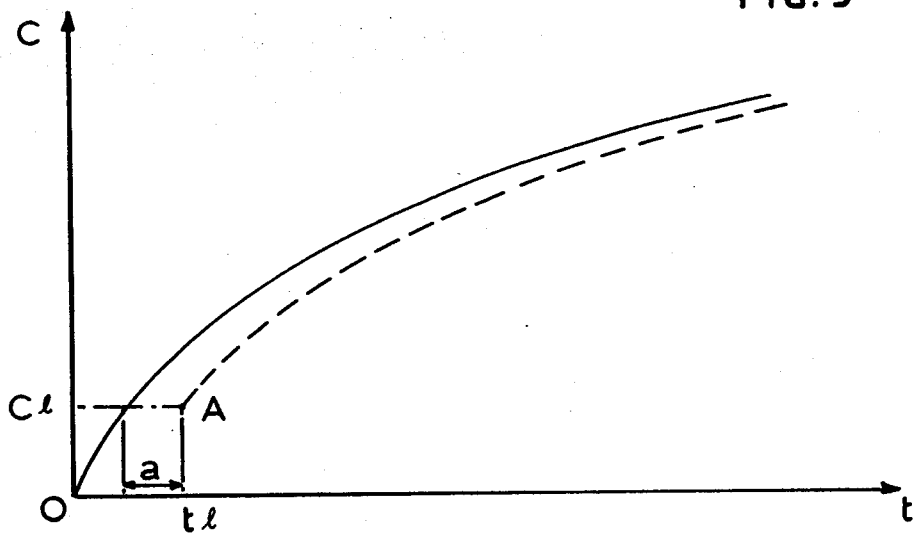
FIG. 3 shows a curve representing the variations of the quantity of heat extracted from a unitary mass of the cast product during its displacement in the installation from the free surface of the metal in the mold, as a function of time.

To determine the quantity of heat to be extracted from each element of the cast product in the secondary cooling zone, the quantity of heat extracted from the metal in the mold must be taken into account. For this purpose, the base curve $C=f(t)$, shown in full line in FIG. 3, is used, which corresponds to the operating conditions (type of steel, shape of cast product, casting speed). This curve is displaced parallel to the time axis until it passes through point A whose coordinates are equal, respectively, to the dwell time $t_1$ of the cast product in the mold and to the quantity of heat $c_1$ actually extracted in the mold. This new curve of the general formula $C=f(t-a)$ is represented in FIG. 3 in broken line.

In each step of the calculation, computer 20 determines the quantity of heat extracted in the mold, on the basis of the cooling medium flow rates continuously measured by flowmeter 28 and the inlet temperature and outlet temperatures of the cooling medium for the mold continuously measured by probes 26, or on the basis of a table of values established by provisional calculations of a simulated operation, and on the basis of this determination, the computer deduces the displacement of the curve which must be taken into account for determining the quantities of heat to be extracted in the secondary cooling zone.

The slab-surface temperature at the outlet end of the mold is measured by means of an optical pyrometer or is calculated on the basis of a curve established by provisional calculations of a simulated operation giving the evolution of this temperature as a function of the quantity of heat extracted in the mold. This curve is stored in the memory of the computer. If this temperature $T'_1$ is different from the theoretical temperature $T_1$ furnished by the curve $T=g(t)$, shown in full line in FIG. 2, corresponding to the operating conditions, the computer will correct the beginning of this curve by admitting, for example, a linear variation of the temperature from the outlet of the mold to a predetermined point of the upper portion of the secondary cooling zone (broken line in FIG. 2) so as to locate the theoretical temperature in this predetermined point. The computer will use this corrected curve to determine the surface temperature for the calculation of the values of the water flow.

The measurement of the slab-surface temperature in the range of straightener 14 is continuously transmitted to computer 20 by pyrometer 32. If this value differs too much from the desired value (for example, if this difference is more than about 50° C.), the computer consequently modifies the calculated values for the lowest secondary cooling zone section or sections. First, computer 20 will correct the water flow rate for the last cooling zone section. The extent of this correction is a function of the difference between the temperature measured by pyrometer 32 and the desired temperature. Then, after a certain time which depends on the position of the last cooling zone section relative to the slab straightener, the computer will correct the water flow rates in the last two cooling zone sections if the difference between the measured and desired slab-surface temperatures is still too big. At the end of another certain time depending on the position of the penultimate cooling zone section relative to the slab straightener, the computer may or may not maintain the corrected water flow rates of the last two cooling zone sections. If desired the water flow rates in preceding cooling zone sections may be progressively corrected in this manner.

If the casting speed varies, there are two possible procedures:

(1) If the speed is modified for a short period of time, of the order of two to four minutes, and then resumes its initial value, the thermal profiles $C=f(t)$ and $T=g(t)$ corresponding to the initial speed are imposed during the transitional period, i.e. the computer continues to utilize the set of curves corresponding to the class of speeds to which the initial speed belongs. This occurs, for instance, during the change of the ladle or distributor.

(2) If, on the other hand, a new casting speed is instituted and maintained for a period of time exceeding that of a predetermined period, for example five minutes, the thermal profiles corresponding to this new casting speed are imposed after this period of time has elapsed. In practice, one passes progressively from the thermal profiles corresponding to the initial speed to those of the new speed by following a law determined by the computer and which limits the speed of surface heating or cooling to a maximum value ranging from 10° C./minute to 200° C./minute.

The progressive change from prior thermal profiles to new ones may also be effected in the following manner: at each step of calculation, the computer attributes an average speed to each element into which the cast product has been fictitiously divided, which speed is a function of its position in the guide rack of the installation and of its age, and calculates the water flow to be projected against this element by utilizing the set of curves $C=f(t)$ and $T=g(t)$ corresponding to the class of speeds to which this average speed belongs. The values of the water flow delivered to each cooling zone section is calculated by integrating the calculated water flow rates for each slab element present in the cooling zone section under consideration. Since this average speed progressively varies until it finally reaches the new speed, assuming the latter to be stable, the water flow rates for each cooling zone section will gradually evolve from those at the initial speed to those of the new speed.

In addition to the water flow rates for the different cooling zone sections and, where used, the total flow of pressurized air for atomizing the water, the computer may also deliver other information such as: an optimal casting speed depending on the nature of the cast metal, the shape of the casting and the temperature of the metal in the distributor; alarm signals in case the temperature of the metal in the distributor departs from present limits; an indication that the calculated water flow rates exceed predetermined maximum values; an indication that the difference between the measured water flow rates and those calculated exceeds, say, 10%; an indication that the real casting speed is in excess of an optimal speed; an indication that the surface temperature at the straightener is too low; and other indications.

The computer may also be used to advantage for controlling the state of the second cooling zone arrangement between two castings. For this purpose, different cooling zone sections will be fed with cooling water. After the water flow rates have been fixed by means of the computer, the real water flow rates and the real pressures are measured and the measured values are compared with the calculated values. If the cooling arrangment is in a good state (no wear, no fouling, no leaks), the measured values should be at least close to the calculated values. More particularly, for a given water flow, the measured pressure should conform to the calculated pressure. The calculated pressures are determined by the computer with the aid of pressure-flow curves which are stored in the memory of the computer and which are pre-established on the basis of experimental results and calculations.

The following conditions must be fulfilled if the automatic control of the secondary cooling of a casting according to the present invention is to be at its maximum effectiveness:

The secondary cooling zone must have a substantial length so as to permit a better control of the solidification of the casting. More particularly, the downstream end of this zone must be as close as possible to the point where the casting is straightened so as to obtain at this point a surface temperature of the slab which is as close as possible to the temperature imposed by the metallurgical constrains.

The secondary cooling zone should be divided into as large a number of individually fed cooling sections as possible so as to realize a precise cooling control in each section supplied seprately by a controlled flow of water and to follow as close as possible the laws of thermal exchange imposed.

The spraying devices used in the secondary cooling zone must have a large range of control of the water flow. The thermal profiles imposed depend, in effect, on the shape of the cast product, on the type of metal and the casting speed, and they must be obtained by different controls of the spraying devices to cover a wide range of types and speeds, permanently and in a transitory operation. Therefore, a wide range of cooling control must be available for each cooling zone section. For this purpose, cooling water spraying devices of the types disclosed in French patents of addition Nos. 74/00227, 74/09449, 75/38986 and 76/32685 may be advantageously used. These devices permit variations in the water flow in a range of 1 to 6, even 1 to 10, while conventional spraying nozzles provided flow variations only in a range of 1 to 3.

What is claimed is:

1. A method of cooling a cast metallic product in a continuous casting installation comprising a casting mold containing molten metal and a secondary cooling zone including a succession of cooling sections through which the cast product is guided, said cast product being fictitiously divided into small elements, which comprises the steps of delivering flows of cooling water at respective flow rates to the successive cooling sections, periodically determining the heat to be extracted from each one of said elements by means of a first curve giving the variations of a quantity of heat extracted from a unitary mass of the cast product as a function of its dwell time in the installation, correcting the first curve before each calculation in direct dependence on the quantity of heat extracted from the molten metal in the mold, determining the surface temperature of said element by means of a second curve giving the variations of the surface temperature of the cast product as a function of its dwell time in the installation, calculating a coefficient of thermal exchange for said one element on the basis of the determined quantity of heat and determined surface temperature, determining a specific water flow rate for said one element by means of a predetermined curve based on the design of the cooling system, and giving the variations of the specific water flow rates as a function of the coefficient of thermal exchange, calculating the flow rate of water to be projected on each one of said elements, integrating the water flow rates for the elements in each successive cooling section in the secondary cooling zone to determine the water flow rates for each successive cooling section in the secondary cooling zone, and controlling the delivery of cooling water to the successive cooling sections so that the water is delivered thereto at the determined flow rates.

2. The cooling method of claim 1, wherein the first curve is corrected by displacing it parallel to a coordinate axis of time until the first curve passes through a point whose coordinates are the dwell time of the molten metal in the mold and the quantity of heat extracted in the mold.

3. The cooling method of claim 1, further comprising the steps of determining the surface temperature of the cast product at the point of emergence from the mold and, if the determined surface temperature differs from the corresponding temperature given by the second curve, correcting the second curve before each calculation of the water flow rates by connecting the point of the curve whose coordinates are, on the one hand, the dwell time in the mold and, on the other hand, the determined surface temperature by a straight line or a curve of the second or third degree to a point of the curve corresponding to a upper section of the secondary cooling zone.

4. The cooling method of claim 1, further comprising the steps of periodically comparing the surface temperature of the cast product at an outlet end of the secondary cooling zone with a desired temperature of the cast product and, if the difference between the temperature exceeds a predetermined value, correcting the water flow rate of at least one of the successive cooling sections adjacent the outlet end.

5. The cooling method of claim 1, further comprising the steps of grouping the casting speeds of the cast product in several classes for each shape of the cast product and type of cast metal, establishing a set of the first and second curves for each casting speed class, measuring the casting speed and calculating the water flow rates by using the set of curves corresponding to the class of casting speeds into which the measured casting speed falls.

6. The cooling method of claim 5, wherein, if the casting speed varies and has not resumed its initial value at the end of a predetermined interim period, the set of curves corresponding to a new casting speed is substituted by the set of curves corresponding to the initial casting speed only at the end of said predetermined interim period.

7. The cooling method of claim 6, wherein the substitution of the sets of curves is effected progressively so that the speed of the variations of the surface temperature of the cast product ranges between 10° C. and 200° C. per minute.

8. The cooling method of claim 5, further comprising the steps of periodically determining the age of each successive element, calculating the average casting speed of said successive elements, and calculating the water flow rate for said elements with the aid of the set of curves corresponding to the average casting speed.

9. The cooling method of claim 1, wherein the second curve gives the variations of the average surface temperature of at least a median portion of one face of the cast product as a function of the dwell time.

10. The cooling method of claim 1, wherein the second curve gives the variations of the average surface temperature over the entire width of at least one face of the cast product as a function of the dwell time.

11. The cooling method of claim 1, wherein the second curve gives the variations of the surface temperature on a median line of one face of the cast product as a function of the dwell time.

12. The cooling method of claim 1, wherein the second curve gives the variations of the surface temperature as the average of the surface temperatures on the median lines of the four faces of the cast product as a function of the dwell time, the cast product being a slab of rectangular cross section.

13. The cooling method of of claim 1 wherein the secondary cooling zone includes means for delivering cooling water in fine droplets, which comprises delivering air under pressure to the cooling water delivering means for dividing the water into the droplets, and calculating the total flow of air delivered to the water delivering means in the secondary cooling zone with the aid of an equation establising a relation between the flows of air and water in the cooling zone.

* * * * *